United States Patent [19]

Maaser

[11] Patent Number: 5,035,814

[45] Date of Patent: Jul. 30, 1991

[54] LIQUID DETERGENT HAVING IMPROVED SOFTENING PROPERTIES

[75] Inventor: Heidrun E. Maaser, Monmouth Junction, N.J.

[73] Assignee: Colgate-Palmolive Company, Piscataway, N.J.

[21] Appl. No.: 68,781

[22] Filed: Jun. 29, 1987

Related U.S. Application Data

[62] Division of Ser. No. 823,906, Jan. 30, 1986, abandoned.

[51] Int. Cl.[5] ..... B06M 1/00; C11D 1/83

[52] U.S. Cl. ..... 252/8.7; 252/8.6; 252/124.17; 252/174.21; 252/559; 252/DIG. 14

[58] Field of Search ..... 252/8.7, 8.6, 174.17, 252/174.21, 540, 559, DIG. 14; 536/18.5

[56] References Cited

U.S. PATENT DOCUMENTS 3,450,690 6/1969 Gibbons et al. ..... 536/18.5
3,721,633 3/1973 Ranauto ..... 252/174.17
3,772,269 11/1973 Lew ..... 252/174.17
4,488,981 12/1984 Urfer et al. ..... 252/174.17

FOREIGN PATENT DOCUMENTS 0105556 4/1984 European Pat. Off. .
0106692 4/1984 European Pat. Off. .

*Primary Examiner*—Hoa Van Le
*Attorney, Agent, or Firm*—Bernard Lieberman; Murray M. Grill; Robert C. Sullivan

[57] ABSTRACT

Liquid detergent compositions having improved softening and detergency properties comprising an alkyl glycoside, as the sole softening agent, a nonionic surfactant and an anionic surfactant as the three essential ingredients; and a method of simultaneously cleaning and softening without reducing brightener and detergency performance, which comprises treating fabrics with said composition in the wash cycle of the laundering operation.

18 Claims, No Drawings

LIQUID DETERGENT HAVING IMPROVED SOFTENING PROPERTIES

This application is a Division of application Ser. No. 823,906, filed 1/30/86, abandoned.

BACKGROUND OF THE INVENTION AND PRIOR ART

The present invention relates to novel softergent liquid composition to be used in the laundering of fabrics, comprising anionic and nonionic surfactants and an alkyl glycoside in an amount effective to improve cleaning efficacy and to provide improved softening properties in the absence of quaternary ammonium softening compounds.

The use of various and diverse chemical materials and particularly cationic quaternary ammonium compounds as softeners for textile products is very well known in the art. It is also well known to employ such materials for their softening effects during the laundering operation and particularly in the rinse cycle of the laundering process. This latter technique has been necessitated by the fact that the aforesaid quaternary compounds heretofore employed, being mainly cationic in nature, were not compatible with the anionic detergents, one of the major types of detergents used in the washing cycle. Furthermore, cationic quaternary compounds are relatively ineffective in the presence of nonionic detergents.

It is also well known that there is a tendency for laundered articles to yellow or discolor when treated with aforesaid quaternary compounds.

Another disadvantage associated with the use of said cationic agents in the laundering of fabrics therewith is its interference with the deposition on the fabrics of optical brightener, thereby reducing optical brightener performance of a detergent composition containing said optical brightener.

Still another disadvantage of the cationic quaternary ammonium antistatic softener is its interference with the cleaning properties of the detergent by reducing the soil removal effected by the detergent, resulting in decreased washing effectiveness. The presence of the anionic detergent material substantially negates the fabric softening properties of the cationic quaternary ammonium compounds..

Accordingly, aforesaid quaternary agents have been combined with a variety of compounds designed to counteract the adverse detergency properties thereof, or said quaternary softening agents have been replaced by other softening agents in order to improve cleaning efficacy.

Higher alkyl mono-and poly-glycosides useful as detergents, textile softeners, surfactants, gelling agents, food emulsifiers and lubricants; and processes for their preparation have been disclosed in U.S. Pat. Nos. 3,598,865; 3,707,535; 3,839,318; 3,772,269; and 3,219,656.

Higher alkyl polyglycosides have been used as nonionic surfactants in a variety of detergent compositions in conjunction with anionic surfactants as shown in U.S. Pat. Nos. 3,721,633, and 4,483,787; European Patent Nos. 0,070,074; 0,070,075; 0,070,076; 0,092,877.

The higher alkyl polyglycosides have also been used to improve the detergency of nonionic surfactants in laundry compositions, as shown in U.S. Pat. No. 4,483,779, European Patent Nos. 0,075,994; 0,075,995 and 0,075,996.

The prior art also discloses detergent compositions containing an alkyl polyglycoside, a conventional nonionic surfactant and a cationic fabric-softening compound to provide both softening and detergency properties during laundering, as shown in U.S. Pat. No. 4,493,773; European Patent Nos. 0,094,118 and 0,106,692. However these patents expressly omit anionic surfactants as being detrimental to the composition.

European Patent No. 0,015,556 discloses a liquid dishwashing detergent capable of promoting rapid and relatively complete drainage of rinse water in order to reduce spotting and filming on surfaces such as glass, ceramics and metal, comprising a major amount of anionic surfactant and minor amounts of higher alkyl polyglycoside and nonionic surfactant.

U.S. Pat. No. 4,488,981 discloses the use of 1–10% $C_2$–$C_6$ alkyl glycosides as a hydrotrope, i.e. to reduce viscosity and prevent phase separation, in detergent compositions containing nonionic and/or anionic and/or cationic surfactants.

However, none of the cited prior art references discloses a liquid softergent composition for simultaneously cleaning and softening fabrics comprising three essential ingredients, and effective softening amount of an alkyl glycoside which also improves detergency properties and a surfactant system consisting essentially of a major amount of a nonionic surfactant and a lesser amount of an anionic surfactant.

SUMMARY OF THE INVENTION

It has now been discovered that the addition of an alkyl polyglycoside surfactant to a stable liquid detergent formula imparts fabric softening properties in the absence of any other known softening agent, and boosts detergency of a nonionic-anionic surfactant system.

Accordingly, it is a primary object of the instant invention to provide a liquid detergent composition having fabric softening properties and improved cleaning efficacy in the absence of cationic quaternary ammonium softening compounds.

Another object of the invention is to provide a liquid detergent composition, that simultaneously cleanses and softens fabrics during the laundering process comprising an alkyl glycoside, a nonionic surfactant and an anionic surfactant as the three essential ingredients.

Still another object of the invention is to provide a liquid detergent formulation having improved cleaning and softening properties, due to the presence of an alkyl glycoside in a detergent composition containing a mixture of nonionic and anionic surfactants.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combination particularly pointed out in the appended claims.

To achieve the foregoing and other objects and in accordance with the present invention, as embodied and broadly described herein, the liquid detergent composition for laundering fabrics of this invention comprises three essential ingredients, an effective fabric softening amount of an alkyl glycoside in the absence of a quaternary ammonium softening compound, a major amount of a nonionic surfactant and a lesser amount of an anionic surfactant in an aqueous carrier; and the method of simultaneously cleansing and softening fabrics without reducing brightener and detergency performance which comprises treating fabrics with said composition during the wash cycle of the laundering operation.

More specifically, present invention relates to a stable liquid detergent composition free of quaternary ammonium softening compounds, comprising a fabric softening amount of a $C_1$–$C_{30}$ alkyl mono- or polyglycoside in an amount of at least about 6% and up to about 30% by weight, a major amount of a nonionic surfactant of about 15–30%, and a lesser amount of an anionic surfactant of about 4–12% by weight, in an aqueous carrier.

The alkyl glycosides function as fabric softening agents as well as boost detergency in a nonionic-anionic surfactant system. It is believed that the alkyl glycosides coat the surface of the fabric and/or alter the fabric structure, thereby imparting softening benefits. It is believed that the alkyl glycosides may disrupt hydrogen-bonding and make it more substantive to fabrics than the quaternary ammonium softening compounds, thereby affording superior softening properties to fabrics in the absence of quaternary softening agents. The alkyl glycosides do not interfere with detergency and/or brightener deposition which is a common problem of softergents. No problems with regard to grease spotting and water proofing occur.

The alkyl glycosides, utilized in present novel softergent, may be defined as having one or more hydrophobic groups containing 1 to 30 carbon atoms per hydrophobic group, and a hydrophilic glycoside group containing 1 to about 10, and preferably from about 1 to 3 saccharide radicals. The alkyl glycosides may be represented by the following formula: $RO(R'O)_xZ_n$, wherein R is a $C_1$–$C_{30}$ alkyl radical, (R'O) is an ethoxy, propoxy or glyceryl group, X has a numerical value of 0–10 and preferably O, Z is a reducing saccharide containing 5 or 6 carbon atoms, and n has a numerical value of 1–10 and preferably 1.0 to 3. The hydrophobic alkyl group may be saturated or unsaturated, branched or straight chain, preferably saturated and linear, containing 1 to 30 carbon atoms, preferably 8 to 23, carbon atoms. Suitable alkyl polyglycosides include methyl, ethyl, propyl, octyl, nonyl, decyl, undecyl, dodecyl, tridecyl, tetradecyl, hexadecyl, heptadecyl, octadecyl and mixtures thereof, monoglycosides, diglycosides, triglycosides, tetraglycosides, penta-glycosides, hexaglycosides, etc. The glycoside units may be glucose, galactose, mannose, lactose and/or fructose. Methods of preparing the aforesaid glycosides are disclosed in U.S. Pat. Nos. 3,598,865; 3,707,535; 3,839,318; 3,772,269; 3,219,656, all of which are incorporated herein by reference. The addition of the alkyl glycoside to the detergent provides fabric softening properties as well as improves the cleaning efficacy thereof. The amount of glycoside should be sufficient to soften fabrics in the absence of known softening agents such as the cationic quaternary ammonium softening agents, and constitutes at least about 6% up to 30% by weight of the composition.

A 3-cycle clean load softening test was conducted using glucose with a $C_{12}$–$C_{13}$ carbon chain attached to the anomeric carbon (APG-23-1). The controls used were Solo=10 and DAP=1. Another formulation using a monotallow-trimethylammonium sulfate (M Quat 620) was included in the test. All softening agents were added at a 6% level. Five panelists evaluated the products.

| | Average | Std. Dev. |
|---|---|---|
| | 1st Wash Cycle | |
| APG 23-1 | 6.8 | 1.8 |
| M Quat 620 | 4.6 | 1.0 |
| | 3rd Wash Cycle | |
| APG 23-1 | 7.6 | 1.4 |
| M Quat 620 | 6.4 | 2.4 |

The unexpected superiority of the alkyl glycoside as a softening agent over the prior art quaternary softener exhibited above, avoids the inherent problems associated with the use of said quaternary compounds in detergent compositions. It is now possible to formulate a composition wherein neither detergency nor softening is compromised.

In accordance with this invention, the nonionic surfactants for use as the fabric detergent are commercially well known and include the primary aliphatic alcohol ethoxylates, secondary aliphatic alcohol ethoxylates, alkylphenol ethoxylates and the alcohol ethylene oxide-propylene oxide condensates such as Plurafacs (Wyandotte), and mixtures thereof. The nonionic synthetic organic detergents are generally the condensation product of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight- or branched-chain configuration with about 5 to 30 moles of ethylene oxide, for example, nonyl phenol condensed with 9 moles of ethylene oxide, dodecyl phenol condensed with 15 moles of ethylene oxide. Condensation products of the corresponding alkyl thiophenols with 5 to 30 moles of ethylene oxide are also suitable.

Also included in the nonionic detergent class are the condensation products of a higher alcohol (e.g. an alkanol containing about 8 to 18 carbon atoms in a straight or branched-chain configuration) condensed with about 5 to 30 moles of ethylene oxide, for example, lauryl-myristyl alcohol condensed with about 16 moles of ethylene oxide.

A preferred group of nonionic surfactants are the Neodol ethoxylates (Shell Co.), which are higher aliphatic alcohol ethoxylates having about 5 to 20 ethyleneoxy groups per mole of aliphatic alcohol containing about 10–18 carbon atoms, such as $C_{12}$–$C_{13}$ alkanol condensed with 6.5 moles ethylene oxide, $C_{12}$–$C_{15}$ alkanol condensed with 12 moles ethylene oxide, $C_{14}$–$C_{15}$ alkanol condensed with 13 moles ethylene oxide, and the like. Ethoxamers having a HLB (hydrophobic lipophilic balance) value of about 8–15 gives good O/W emulsification, whereas ethoxamers with low HLB values (Below 8) contain less than 5 ethlenoxy groups, and are poor emulsifiers and poor nonionic detergents. This nonionic surfactant is present in the detergent composition in an amount greater than the anionic surfactant content, and about 15–30% by weight. The nonionic surfactant, i.e. the nonionic alcohol ethoxylates defined above, constitute the major detergent component in this composition.

The anionic surfactants utilized in the detergent of this invention are commercially well known and include alkylbenzenesulfonic acid and its salts, e.g. compounds of the formula alkyl-phenyl-$SO_3$-M, wherein alkyl is an alkyl radical of $C_8$ to $C_{22}$ and preferably $C_{10}$ to $C_{18}$ and M is hydrogen or an alkali metal, which compounds comprise a well-known class of anionic detergents and include sodium dodecyl-benzene sulfonate, potassium dodecylbenzenesulfonate, sodium laurylbenzenesulfonate, sodium cetylbenzene sulfonate. Others include paraffin sulfonates, alkyl sulfates, alcohol ether sulfates, olefin sulfonates and the alkylphenolethoxylate sulfates (e.g. sodium dinonylphenoxynonaethoxyethanol sulfate), and other equivalent water-soluble salts, particularly of the alkali metal series.

Among the above-noted alkylbenzene-sulfonic acid and salts thereof, the preferred compounds include those which are biodegradable and which are particularly characterized by a linear alkyl substituent of from $C_{10}$ to $C_{22}$ and preferably from $C_{12}$ to $C_{15}$. It is, of course, understood that the carbon chain length represents, in general, an average chain length since method for producing such products usually employs alkylating reagents of mixed chain length. It is clear, however, that substantially pure olefins as well as alkylating compounds used in other techniques can and do give alkylated benzene sulfonates wherein the alkyl moiety is substantially (i.e., at least 99%) of one chain length, i.e., $C_{12}$, $C_{13}$, $C_{14}$, or $C_{15}$. The linear alkyl benzene sulfonates are further characterized by the position of the benzene ring in the linear alkyl chain with any of the position isomers (i.e., alpha to omega) being operable and contemplated.

In addition to the benzene sulfonates one may also employ the lower alkyl ($C_1$ to $C_4$) analogs of benzene such as toluene, xylene, the trimethyl benzenes, ethyl benzene, isopropyl benzene and the like. The sulfonates are generally employed in the water soluble salt form which include as the cation, the alkali metals, ammonium and lower amine, and alkanolamine cations.

Examples of suitable linear alkyl benzene sulfonates include:

sodium n-decyl benzene sulfonate
sodium n-dodecyl benzene sulfonate
sodium n-tetradecyl benzene sulfonate
sodium n-pentadecyl benzene sulfonate
sodium n-hexadecyl benzene sulfonate and the corresponding lower alkyl substituted homologues of benzene as well as the salts of the cations previously referred to. Mixtures of these sulfonates may, of course, also be used with mixtures which may include compounds wherein the linear alkyl chain is smaller or larger than indicated herein provided that the average chain length in the mixture conforms to the specific requirements of $C_{10}$ to $C_{22}$.

The linear paraffin sulfonates are also a well-known group of compounds and include water-soluble salts (alklai metal, amine, alkanolamine, and ammonium) of:

1-decane sulfonic acid
1-dodecane sulfonic acid
1-tridecane sulfonic acid
1-tetradecane sulfonic acid
1-pentadecane sulfonic acid
1-hexadecane sulfonic acid as well as the other position isomers of the sulfonic acid group.

In addition to the paraffin sulfonates illustrated above, others with the general range of $C_{10}$ to $C_{22}$ alkyls may be used, with the most preferable range being from $C_{12}$ to $C_{20}$.

The linear alkyl sulfates which are contemplated in this invention comprise the range of $C_{10}$ to $C_{20}$. Specific examples include sodium n-decyl sulfate; sodium n-dodecyl sulfate; sodium n-hexadecyl sulfate, sodium n-heptadecyl sulfate; sodium n-octadecyl sulfate; and the ethoxylated (1 to 100 moles ethylene oxide) derivatives such as the ethoxylated alcohol sulfates, and, of course, the other water-soluble salt-forming cations mentioned above.

Included in the group of anionic detergents, which have been described above as suitable in the present invention, are the olefin sulfates, including long chain alkene sulfonates, long chain hydroxyalkane sulfonates, as well as disulfonates. Examples of suitable olefin sulfonates, which are merely illustrative of the general class, are sodium dodecenyl-1 sulfonate, sodium tetradecenyl-1 sulfonate, sodium hexadecenyl-1 sulfonate, and sodium octadecenyl-1 sulfonate. The amount of anionic surfactant utilized in present composition is considerably less than the nonionic (ethoxylated aliphatic alcohol) surfactant content by weight, and preferably less than 50% by weight of the nonionic surfactant content, and constitutes about 4–12% by weight, of the composition.

The detergent composition of the instant invention may also include conventional laundering additives such as optical brighteners, germicides, soil suspending agents, anti-redisposition agents, antioxidants, coloring materials (dyes and pigments), perfumes, water-soluble alcohols, foam boosters, hydrotropes such as sodium and potassium xylene sulfonates, sodium and potassium toluene sulfonates, cumene sulfonates, ethyl benzene sulfonate and the like, enzymes and enzyme stabilizers, and builders such as tripolyphosphate, bicarbonate, etc., provided they do not interfere with the detergency and softening activity of the composition.

DETAILED DESCRIPTION OF THE INVENTION

The following examples are merely illustrative of the invention and are not to be construed as limiting thereof.

| Example 1 | |
|---|---|
| C12–15: 7 M ethoxylated alcohol (Shell Neodol 25-7) | 20.0% |
| Dodecyl benzene sulfonate | 4.0% |
| Methyl glucoside | 6.0% |
| Ethanol | 4.0% |
| Sodium Xylene Sulfonate | 4.0% |
| Triethanolamine | 1.0 |
| Perfume | 0.4 |
| Color | 0.5 |
| Water | Q.S. |

The liquid detergent is prepared by mixing the above ingredients until homogeneous to form a stable liquid composition.

| Example 2 Detergent | |
|---|---|
| 21% | Neodol 25-7 |
| 4% | sodium dodecyl benzene sulfonate |
| 6% | methyl glycoside |

-continued

| Example 2 Detergent | |
|---|---|
| 0.4% | brightener |
| 8% | ethanol |
| 5% | sodium xylene sulfonate |
| 0.5% | color |
| Q.S. | water |

This formulation was tested in a 5 cycle, 6 lbs. clean load softness test using Solo as the control having the greatest softness (10). The softness rating of this formulation, which is 7.2 (the average of these readings after the 1st, 3rd and 5th cycle) compares favorably to Solo, as shown in Table I. The softness rating is within a range of 1 (the harshest) to 10 (the softest). The absence of the glycoside in Products 1 and 2 containing a quaternary softening agent yields a composition having lower softening properties (5.9 and 5.8 respectively). The conjoint use of the quaternary softening agents and the glycoside yields improved softness ratings of 6 and 6.8 (Products 3 and 4). However, superior softening properties is effected by the sole use of the alkyl glycoside (Product 5) over the conventional quaternary softening agents.

The following Table I summarizes the brightening and static results of the 5-cycle softening/static/brightener tests of 5 test products and 2 controls. Fluorescence of the cotton swatches is read as a measure of brightener effectiveness (Rb).

TABLE I

| | Products: Control | | | | | | |
|---|---|---|---|---|---|---|---|
| | DYNAMO | SOLO | Liq. Det. 6/6 | Liq. Det. 5/5/6E | Soft. 4/4/3E/ 2MG | Soft. 4/4/ 2MG | Soft. 4/0/6MG Ex. 2 |
| Static Control | moderate to heavy | light v light | very light | light v light | very light | light v light | moderate heavy |
| Brightening 1st wash | 188.5 | 102.9 | 214.7 | 211.1 | 216.3 | 227.7 | 228.5 |
| 3rd wash | 223.1 | 95.9 | 240.4 | 228.2 | 241.9 | 253.2 | 254.2 |
| 5th wash | 209.7 | 90.5 | 222.4 | 228.9 | 237.4 | 251.4 | 257.0 |
| Softness | 1 | 10 | 5.9 | 5.8 | 6.0 | 6.8 | 7.2 |
| SRI | — | 171.5 | 186.1 | 190.2 | 186.6 | 193.4 | 184.1 |

1. 6% dodecylbenzene sulfonate (DBS)/6% tallow trimethyl quat (quat)
2. 5% DBS/5% quat/6% tallow amine 15 ethylene oxide (TAEO)
3. 4% DBS/4% quat/3% TAEO/2% methyl glycoside (MG)
4. 4% DBS/4% quat/2% MG
5. 4% DBS/0% quat/6% MG The above results indicate that methyl glucoside imparts superior softening benefits to fabric. The lab tests also indicate that the glucoside imparts superior brightening benefits in liquid formulations. However, in the absence of quat., no static control is achieved.

The detergents containing an effective fabric softening amount of an alkyl glycoside have been unexpectedly found to improve the detergency and the softening properties of the detergent composition, in the absence of conventional softening agents, such as quaternary ammonium compounds. This is clearly shown in Table I by Product 5 containing 6% methyl glycoside. Likewise, Product 5 exhibits a greater brightness after the 1st, 3rd and 5th wash cycle, that Products 1, 2, 3 and 4.

| LIQUID DETERGENTS | Examples 3-8 | | | | | |
|---|---|---|---|---|---|---|
| Ingredients | 3 | 4 | 5 | 6 | 7 | 8 |
| Neodol 25-7 | 24.0 | 24.0 | 24.0 | 24.0 | 24.0 | 21 |

-continued

| LIQUID DETERGENTS | Examples 3-8 | | | | | |
|---|---|---|---|---|---|---|
| Ingredients | 3 | 4 | 5 | 6 | 7 | 8 |
| Dodecyl benzene sulfonate | 10.5 | 10.5 | 10.5 | 10.5 | 10.5 | 6 |
| Sodium Xylene sulfonate | 15.0 | 15.0 | 15.0 | 15.0 | 15.0 | 5 |
| $C_{12-13}$ glycoside | 22.6 | | | | | |
| $C_{9-11}$ glycoside | | 23.5 | | | | |
| $C_{12-13}$ triglycoside | | | 26.1 | | | |
| $C_{9-11}$ triglycoside | | | | 21.1 | | |
| Methyl glucoside | | | | | 12.0 | |
| Tallow trimethyl ammonium sulfate | | | | | | 6 |
| $H_2O$ | Q.S | Q.S | Q.S | Q.S. | Q.S. | Q.S. |

The above compositions were subjected to a three cycle 1½ lbs. clean g fabric load test to ascertain the softening properties of the alkyl glycosides using commercial products Solo=10 as control ranging from the softest (10) to the harshest (1). Example 8 contains a quaternary ammonium softening agent in lieu of the alkyl glycoside.

| Softness Ratings: | Cycle 1 | Cycle 3 |
|---|---|---|
| Example 3 | 6.8 | 4.4 |
| Example 4 | 5.2 | 3.8 |
| Example 5 | 5.6 | 4.0 |
| Example 6 | 5.2 | 6.2 |
| Example 7 | 3.6 | 3.0 |
| Example 8 | 3.6 | 6.4 |
| Solo (Control) | 9.8 | 10.0 |

These results illustrate the fabric softening properties exhibited by detergent compositions containing alkyl glycosides in a nonionic-anionic surfactant system wherein the nonionic surfactant is the primary detergent supplemented by minor amounts of anionic surfactant, in the absence of quaternary ammonium softening agents.

Amounts as low as 6% alkyl glycoside is efffective in improving both the detergency and softening properties of a detergent composition used in the laundering of fabrics. In addition, present formulations exhibit better cleaning and softening efficacy than other surfactant and/or softener combinations presently on the market, as shown by the comparative results in Table I.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

What is claimed is:

1. A method of simultaneously cleansing and softening fabrics without reducing brightener and detergency performance which comprises treating fabrics with an aqueous liquid detergent composition consisting essentially of about 6 to 30% by weight of a $C_8$–$C_{23}$ alkyl mono- or polyglycoside as the sole softening agent in a nonionic-anionic surfactant system consisting of a major amount of about 15–30% by weight of a nonionic surfactant and a lesser amount of about 4–12% of an anionic surfactant, in the wash cycle of the laundering operation.

2. The method according to claim 1 wherein said composition also contains a brightener.

3. The method according to claim 1, wherein the glycoside is $C_{12}$–$C_{13}$ alkyl glycoside.

4. The method according to claim 1, wherein the glycoside is $C_{12}$–$C_{13}$ alkyl triglycoside.

5. The method according to claim 1 wherein the alkyl mono- or polyglycoside has a saturated or unsaturated, branched or straight chain alkyl group and a hydrophilic glycoside group containing 1 to 10 reducing saccharide radicals.

6. The method according to claim 1, wherein the nonionic surfactant is selected from the group consisting of primary aliphatic alcohol ethoxylates, secondary aliphatic alcohol ethoxylates, alkylphenol ethoxylates, alcohol ethylene-oxide-propylene oxide condensates and mixtures thereof.

7. The method according to claim 7, wherein the nonionic surfactant is a $C_{12}$–$C_{15}$ aliphatic alcohol having 7 ethylene-oxy groups per mole of alcohol.

8. The method according to claim 1, wherein the anionic surfactant is selected from the group consisting of alkyl benzene sulfonates, alcohol ether sulfates and ethoxylated alcohol sulfates.

9. The method according to claim 9, wherein the anionic surfactant is sodium dodecyl benzene sulfonate.

10. The method according to claim 1, wherein the anionic surfactant content is less than 50% by weight of the nonionic surfactant content.

11. A method of simultaneously cleansing and softening fabrics without reducing brightener and detergency performance which comprises treating fabrics with an aqueous liquid detergent composition consisting essentially of about 6 to 30% by weight of a methyl mono- or polyglycoside as the sole softening agent in a nonionic-anionic surfactant system consisting of a major amount of about 15–30% by weight of a nonionic surfactant and a lesser amount of about 4–12% of an anionic surfactant, in the wash cycle of the laundering operation.

12. The method according to claim 11 wherein said composition also contains a brightener.

13. The method according to claim 12 wherein the hydrophilic glycoside group contains 1 to 10 reducing saccharide radical.

14. The method according to claim 11, wherein the nonionic surfactant is selected from the group consisting of primary aliphatic alcohol ethoxylates, secondary aliphatic alcohol ethoxylates, alkylphenol ethoxylates, alcohol ethylene-oxide-propylene oxide condensates and mixtures thereof.

15. The method according to claim 14, wherein the nonionic surfactant is a $C_{12}$–$C_{15}$ aliphatic alcohol having 7 ethylene-oxy groups per mole of alcohol.

16. The method according to claim 11, wherein the anionic surfactant is selected from the group consisting of alkyl benzene sulfonates, alcohol ether sulfates and ethoxylated alcohol sulfates.

17. The method according to claim 11, wherein the anionic surfactant is sodium dodecyl benzene sulfonate.

18. The method according to claim 11, wherein the anionic surfactant content is less than 50% by weight of the nonionic surfactant content.

* * * * *